US010745941B2

(12) United States Patent
Fang et al.

(10) Patent No.: US 10,745,941 B2
(45) Date of Patent: Aug. 18, 2020

(54) LATCHING ASSEMBLY FOR BARRIER GATE

(71) Applicant: Munchkin, Inc., Van Nuys, CA (US)

(72) Inventors: Ruth Hsin-Ju Fang, Monterey Park, CA (US); Thomas Birkert, West Hills, CA (US); Stephen Kong, Hong Kong (HK); Stephen Chan, Hong Kong (HK)

(73) Assignee: Munchkin, Inc., Van Nuys, CA (US)

( * ) Notice: Subject to any disclaimer, the term of this patent is extended or adjusted under 35 U.S.C. 154(b) by 327 days.

(21) Appl. No.: 15/213,219

(22) Filed: Jul. 18, 2016

(65) Prior Publication Data

US 2017/0073998 A1 Mar. 16, 2017

Related U.S. Application Data

(60) Provisional application No. 62/194,052, filed on Jul. 17, 2015.

(51) Int. Cl.

| | |
|---|---|
| ***E05B 65/00*** | (2006.01) |
| ***E05B 63/14*** | (2006.01) |
| ***E06B 9/04*** | (2006.01) |
| *E06B 9/00* | (2006.01) |
| *E05B 63/04* | (2006.01) |

(52) U.S. Cl.

CPC ..... *E05B 65/0007* (2013.01); *E05B 63/143* (2013.01); *E06B 9/04* (2013.01); *E05B 63/04* (2013.01); *E05B 65/0014* (2013.01); *E06B 2009/002* (2013.01)

(58) Field of Classification Search

CPC ..... E06B 9/00; E06B 9/02; E06B 9/04; E06B 3/46; E06B 2009/002; E05B 65/0007; E05B 65/0014; E05B 63/14; E05B 63/143; Y10T 292/0801; Y10T 292/0803; Y10T 292/0805; Y10T 292/0834; Y10T 292/0836; Y10T 292/68; Y10T 292/696; Y10T 292/702; Y10T 292/0846; Y10T 292/0849; Y10T 292/086; Y10T 292/0848; Y10T 292/54; Y10T 292/558; Y10T 292/564; Y10S 292/04; Y10S 292/29

USPC ..... 49/55–57, 63, 67, 394, 50, 463, 465

See application file for complete search history.

(56) References Cited

U.S. PATENT DOCUMENTS

| | | | | |
|---|---|---|---|---|
| 574,518 | A * | 1/1897 | Berry | E05B 85/24 292/44 |
| 728,087 | A * | 5/1903 | Deardorff | E05B 65/0007 292/341.17 |
| 821,363 | A * | 5/1906 | Jackson | E05B 85/247 292/53 |
| 842,046 | A * | 1/1907 | Williams | E05B 65/0007 292/341.17 |
| 989,649 | A * | 4/1911 | Schenck | E05B 65/0007 292/120 |

(Continued)

*Primary Examiner* — Alyson M Merlino

(74) *Attorney, Agent, or Firm* — Robert Z. Evora, Esq.

(57) ABSTRACT

A barrier latch assembly having a housing including a first locking element, a second locking element, a trigger and a swing plate. The swing plate is coupled to the trigger and to the first and second locking elements. When the trigger is depressed, the swing plate pivots from an unlock position to a lock position over a rear side of the first and second locking element thereby blocking and preventing the first and second locking elements from being depressed inward.

19 Claims, 16 Drawing Sheets

(56) References Cited

U.S. PATENT DOCUMENTS 1,253,822 A * 1/1918 Henkle ..... E05B 85/24 292/213
1,280,653 A * 10/1918 Brady ..... E05B 85/243 292/216
1,289,708 A * 12/1918 Enok ..... E05C 9/02 292/45
1,347,991 A * 7/1920 Clay ..... E05B 65/0007 292/216
1,450,443 A * 4/1923 Judge ..... E05B 65/0007 292/40
1,528,093 A * 3/1925 Anderson ..... E05B 65/0007 292/238
1,538,056 A * 5/1925 Olson ..... E05B 65/0007 292/213
1,542,151 A * 6/1925 Lehtonen ..... E05F 11/04 292/25
1,600,092 A * 9/1926 Calkins ..... E05B 65/0007 292/48
1,656,278 A * 1/1928 Jarvis ..... E06B 5/16 292/241
1,904,291 A * 4/1933 Neilson ..... E05B 65/0007 292/198
2,510,520 A * 6/1950 Remmele ..... E05B 65/0007 292/210
2,592,871 A * 4/1952 Dole ..... E05B 65/0007 292/134
2,693,043 A * 11/1954 Leake ..... E05F 1/04 292/341.17
2,698,197 A * 12/1954 Jacobson ..... E05B 63/20 292/336
2,860,903 A * 11/1958 Narancich ..... E05B 65/06 292/341.17
4,083,591 A * 4/1978 Parisien ..... E05B 65/06 292/202
4,355,829 A * 10/1982 Gregory ..... E05B 65/0007 292/216
4,371,200 A * 2/1983 Porter ..... E05B 65/0007 292/127
4,592,578 A * 6/1986 Martin ..... E05B 65/06 292/148
4,792,165 A * 12/1988 Nishimura ..... E05C 19/022 292/19
4,923,231 A * 5/1990 Bergman ..... E05B 65/0007 292/205
6,711,857 B1 * 3/2004 Wagnitz ..... E05B 65/0014 49/394
2015/0101253 A1 * 4/2015 Marsden ..... E05B 65/0007 49/386

* cited by examiner

FIG. 12
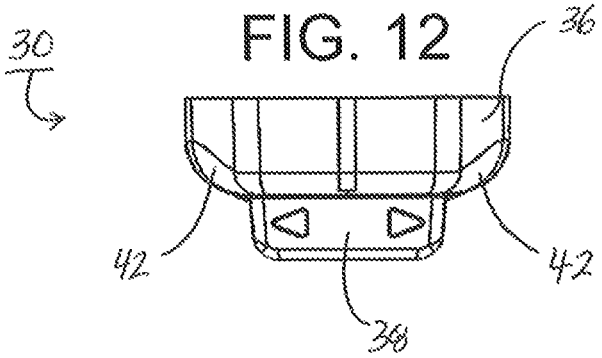
FIG.11
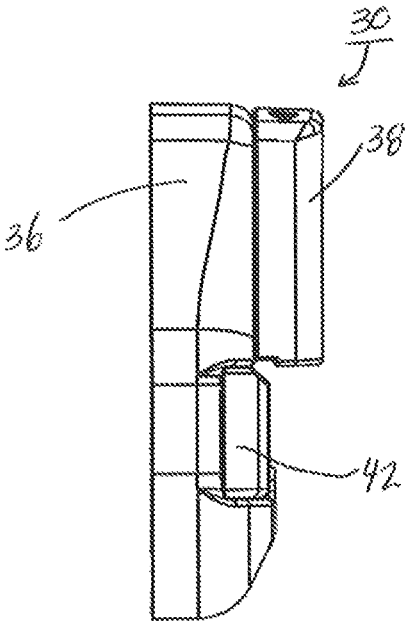
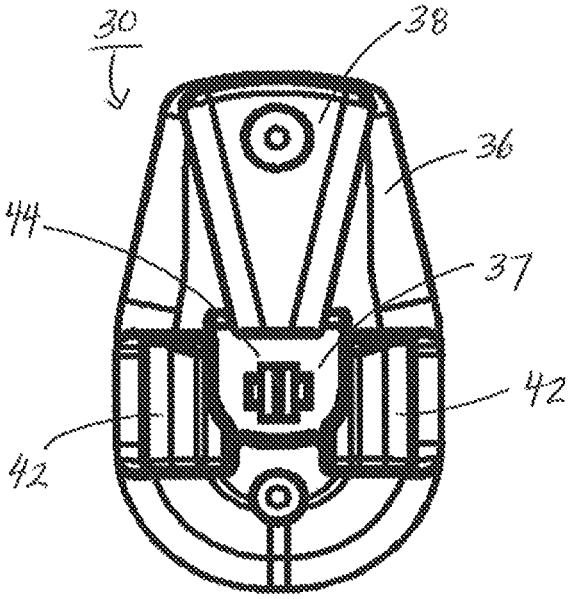
FIG. 10
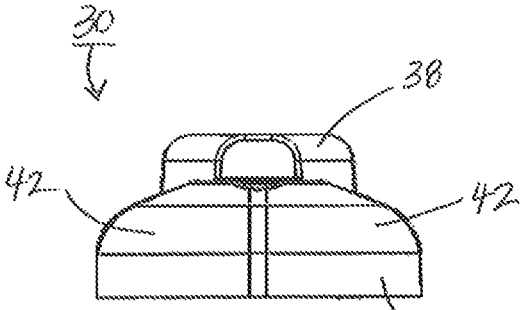
FIG. 13

FIG. 19
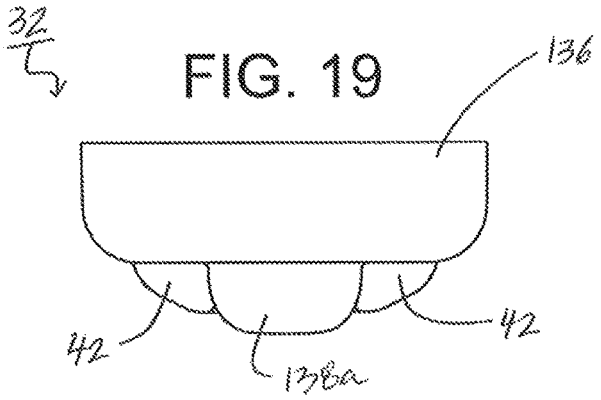
FIG. 18
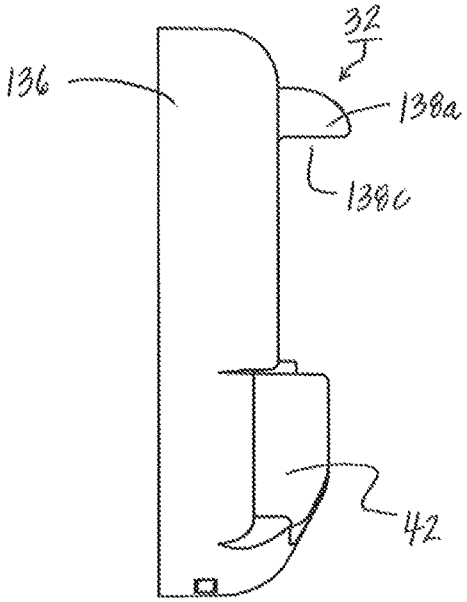
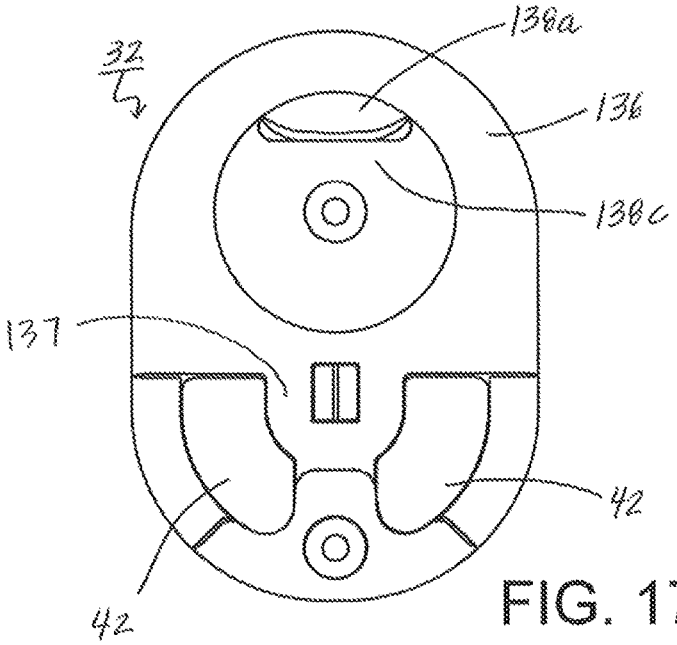
FIG. 17
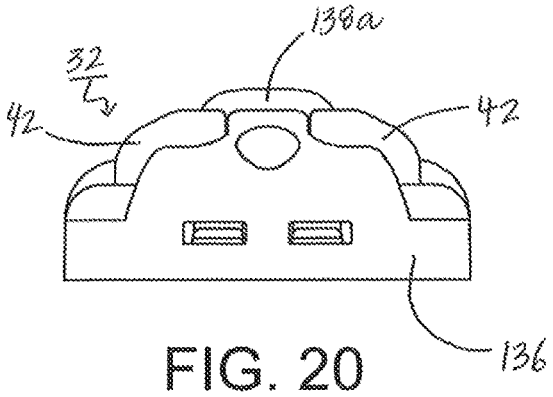
FIG. 20

LATCHING ASSEMBLY FOR BARRIER GATE

CROSS REFERENCE TO RELATED APPLICATION

This application claims priority to U.S. Provisional Patent Application Ser. No. 62/194,052, filed Jul. 17, 2015; the contents of which are hereby incorporated by reference herein in their entirety into this disclosure.

TECHNICAL FIELD

The subject disclosure relates to a barrier assembly and particularly to a safety gate assembly having an easy to close latching assembly for a barrier gate.

BACKGROUND

Various child safety barriers are know which are removably located in an opening of a doorway, stairway and/or the like to prevent a child or animal from going through the opening when the barrier is fitted and in a closed position. These conventional barriers typically include a frame which is fitted to the side walls of an opening. Likewise, a gate or barrier is hingedly or slidably mounted to the frame for movement between open and closed positions.

In order to ensure that the child safety barrier is not accidentally opened by a young child, some conventional gates require a user to exert a substantially vertical lifting force to an upper portion of the gate to overcome a lock position prior to opening the gate. The position of where the lifting force is to be exerted on the gate is considered out of reach for a young child, and the required lifting force is sufficiently large to prevent a young child from opening the gate. However, a problem with such gates is that a user can accidentally apply a twisting or horizontal force in addition to the lifting force when opening the gate and this can damage the hinges of the gate because most hinges are not designed to undergo such angular movement. As a result, the gate may be damaged and prevented from opening and closing smoothly over time due to hinge damage. Furthermore, any latch mechanism provided on the gate may become out of alignment with the latch retaining means to prevent correct latching of the gate in a closed position.

For example, FIG. 1 illustrates a conventional gate assembly 2 including a barrier gate in the form of two gate panels 4, 6 for demonstrative purposes. As shown, the gate panels 4, 6 are slidably mounted to each other to allow adjustment of the width of the barrier gate to allow the gate assembly 2 to fit in different sized openings through which selective entry is required. The gate assembly 2 may be used as a child safety barrier to prevent young children or small animals from passing through the opening without adult supervision.

Each gate panel 4, 6 include a base member 8, 8' and a top member 10, 10' respectively. A plurality of upright strut members 12, 12' are located at spaced apart intervals between the top 10, 10' and base members 8, 8'.

At one side 14 of gate panel 6 there is provided upper and lower hinges 16, 18 respectively. At the opposite side 20 on gate panel 4, there are associated upper and lower latch mechanisms 22, 24 respectively. The upper and lower hinge means are typically substantially vertically and horizontally aligned with the upper and lower mechanisms respectively. Various difficulties have existed with the upper and lower latch mechanisms 22, 24 of conventional systems in that the gate assembly 2 required the user to carefully lift the gate 2 upward upon opening and closure in order to secure the upper and lower latch mechanisms 22, 24. Although various solutions have been proposed, none available has effectively solved this cumbersome issue.

BRIEF DESCRIPTION OF DRAWINGS

FIGS. 10-13 depict various orthographic views of the upper catch mechanism.

FIGS. 17-20 depict various orthographic views of the lower catch mechanism.

DETAILED DESCRIPTION

Figure 1:
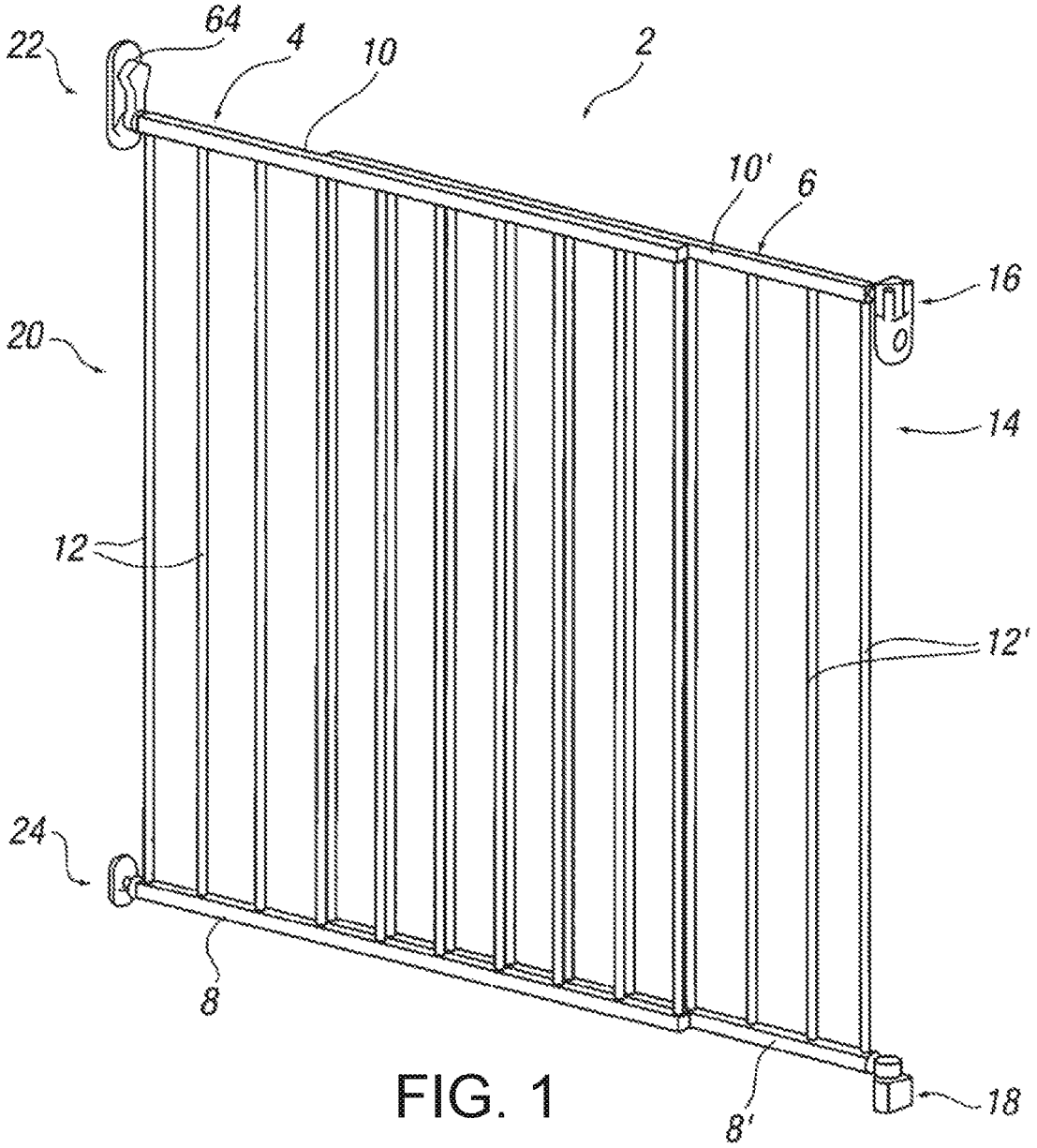
FIG. 1 PRIOR ART
FIG. 1 illustrates a conventional gate assembly.

The subject disclosure is described with reference to the drawings, wherein like reference numerals are used to refer to like elements throughout. In the following description, for purposes of explanation numerous specific details are set forth in order to provide a thorough understanding of the present disclosure. It may be evident, however, that the present disclosure may be practiced without these specific details.

Figure 2A:
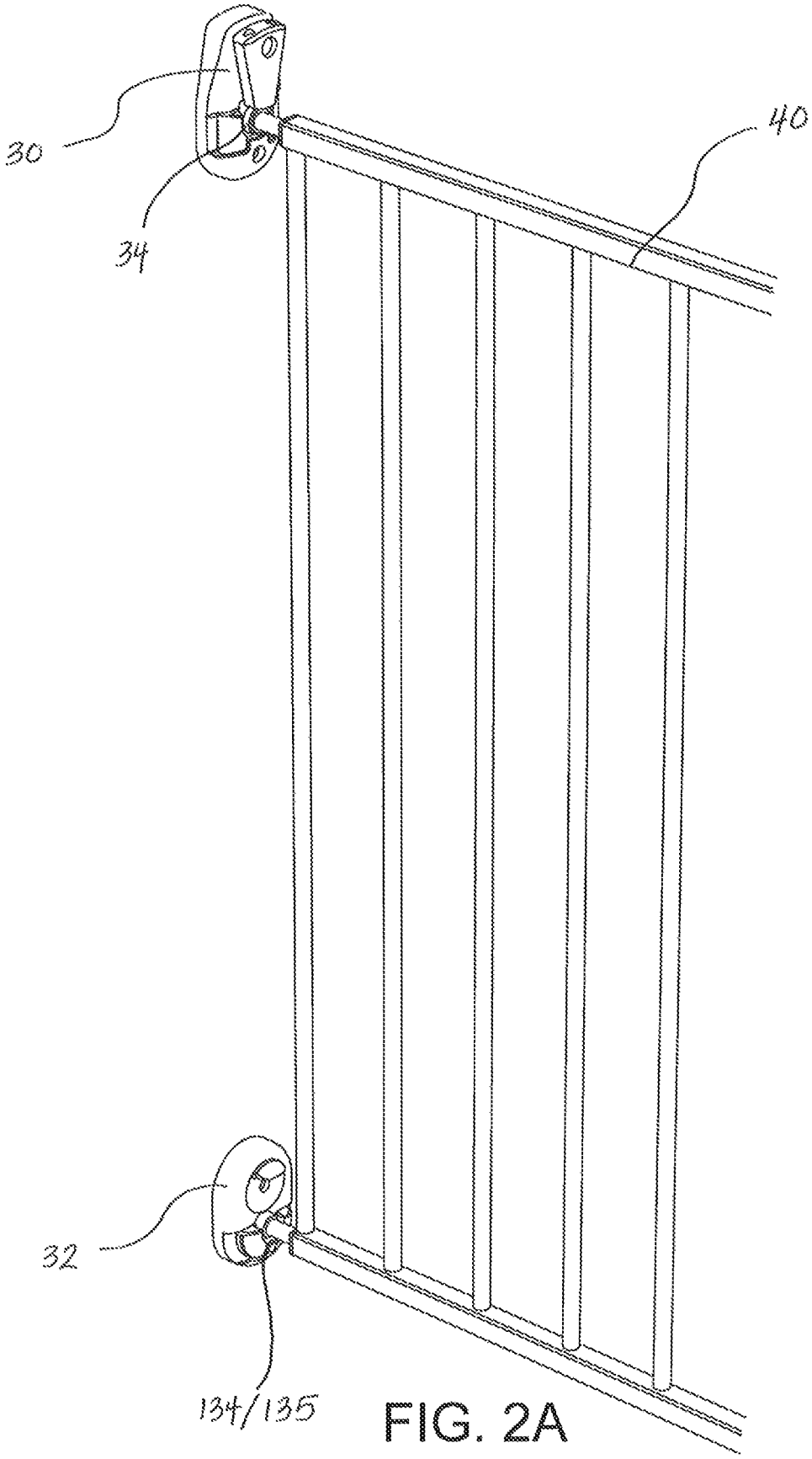
FIG. 2A depicts an exemplary view of the upper and lower catch mechanisms according to this subject disclosure.
Figure 2B:
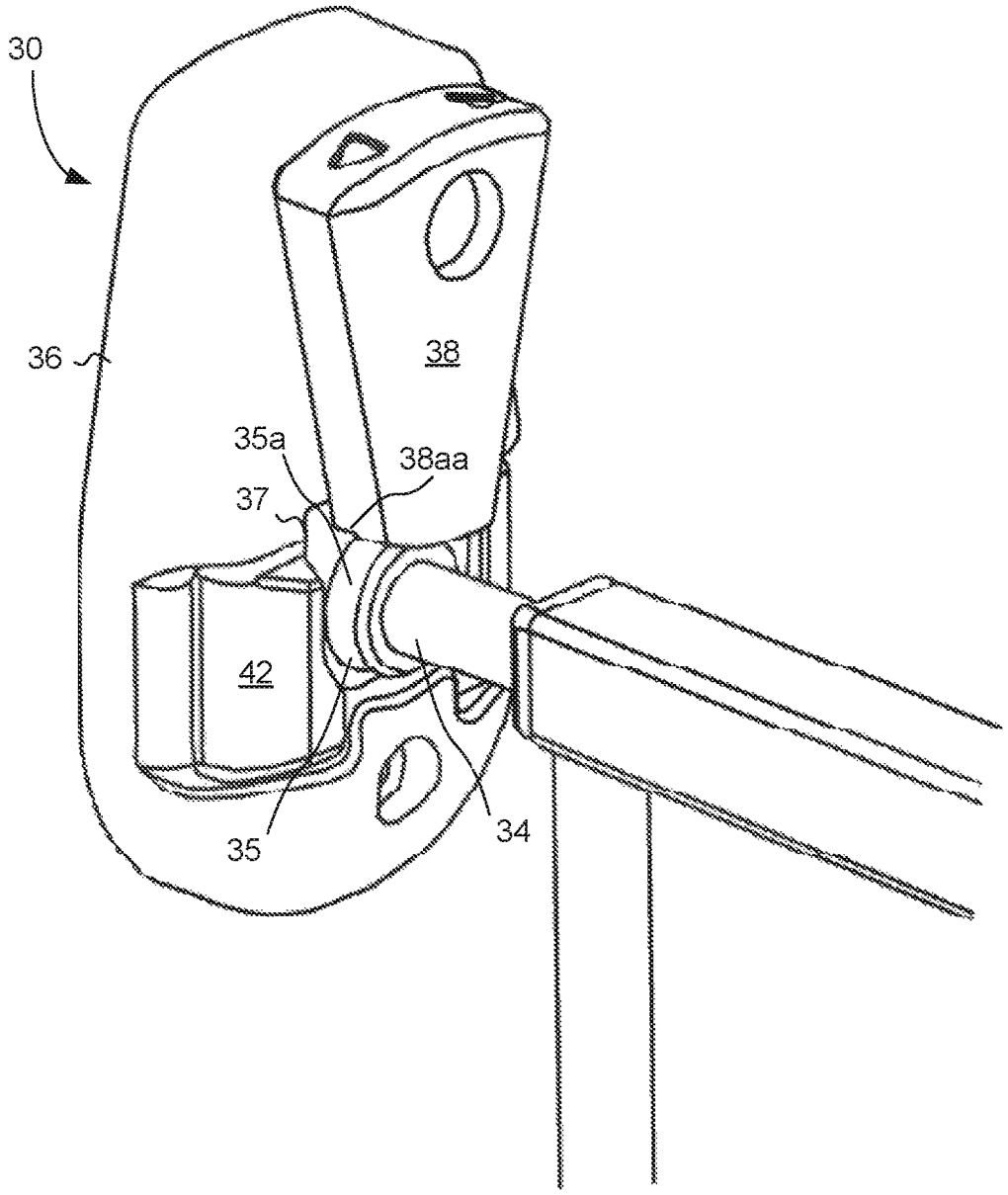
FIG. 2B shows another perspective view of the upper catch mechanism.

FIG. 2A shows an exemplary upper latch mechanism 30 and a lower latch mechanisms 32 according to this subject disclosure receiving an upper latch element 34 and a lower latch element 134. The ends of the upper latch element 34 and the lower latch element 134 are adjustable. Although shown as threadedly adjustable, it is to be understood that various methods for adjustment may be adopted according to this subject disclosure.

FIGS. 2B and 3-5 depict various images of the upper latch mechanisms 30 shown with and without the adjustable latch element 34. As shown, the adjustable latch element 34 is connected to the barrier gate 40. In use the adjustable latch element 34 is secured within a central portion of the upper latch mechanism 30 between a pair of retractable locking elements 42 and a pivoting locking element 38.

Figure 4:
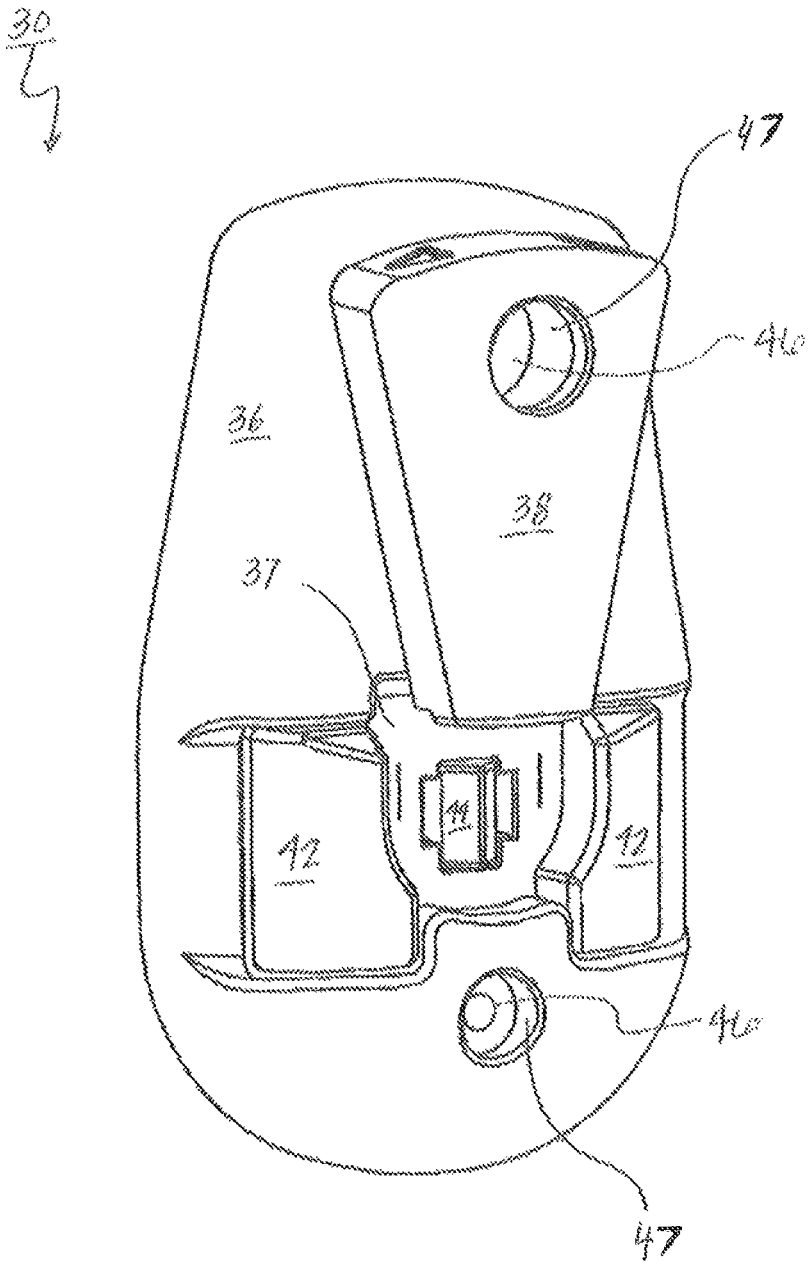
FIGS. 4-5 depict a perspective and front view of e upper catch mechanism.
Figure 5:
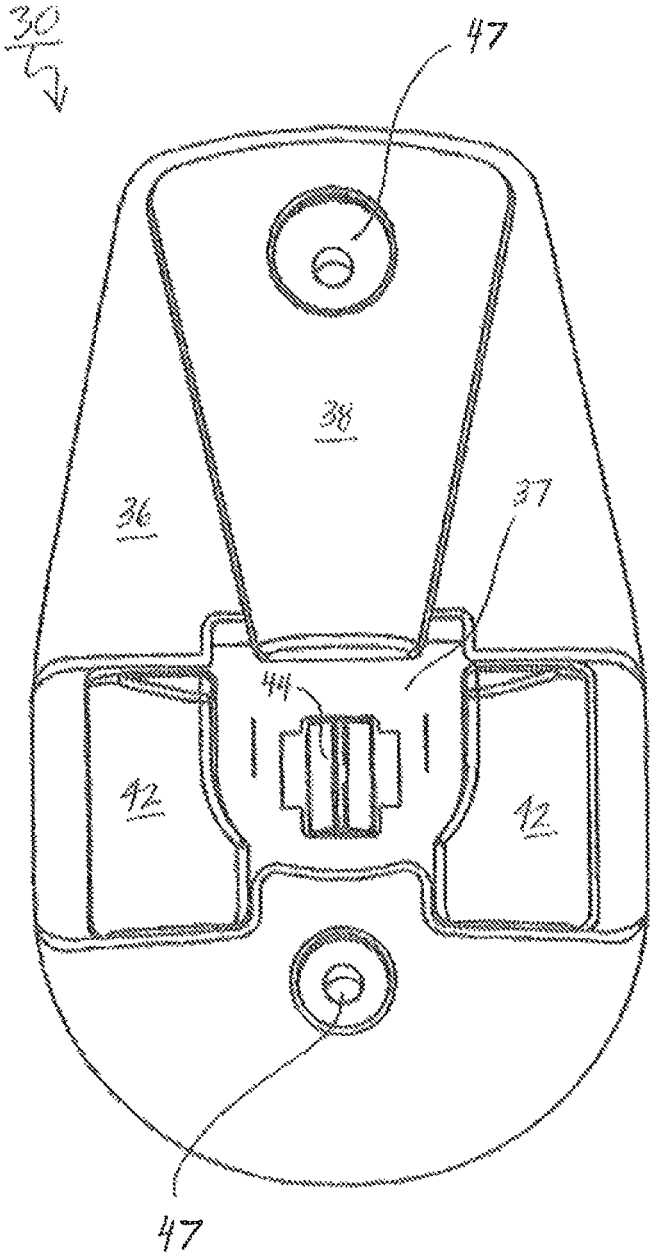

FIGS. 4-5 illustrate the upper latch mechanisms 30 in more detail. The upper latch mechanisms 30 includes a keeper housing 36 with a pivoting locking element 38, a pair of retractable locking elements 42 and a trigger 44 disposed at a central location between the retractable locking elements 42.

In a closed position, the adjustable end 35 of the latch element 34 is received in a cavity 37 formed between the lower end surface of the pivoting locking element 38 and the inner surfaces of the pair of retractable locking elements 42. That is, a lip 35*a* (FIG. 2B) on the adjustable end 35 of the latch element 34 is received by a notched shoulder 38*aa* provided at the lower end of the lower end surface of the pivoting locking element 38. The inner surfaces of the pair of retractable locking elements 42 keep the adjustable end 35 of the latch element 34 secured within the recess 37 and prevent the latch element 34 from moving laterally out of the recess 37. In the closed position, the adjustable end 35 of the latch element 34 lies over the trigger 44 depressing it inward into the keeper housing 36. When the trigger 44 is depressed, internal swing plates 48 or locking elements swing outward behind the retractable locking elements 42 thereby preventing the retractable locking elements 42 from being depressed and securing the adjustable end 35 of the latch element 34 within the cavity 37. As such, the gate door 40 is secured in a closed position and is prevented from moving forward, backward or upward out of the recess.

A pair of fasteners 46 may be provided in a securing aperture 47 in the keeper housing 36 to secure the upper latch mechanism 30 to a surface in the opening into which the barrier gate 40 is secured. As will be labeled in the various images herein, various other fasteners 46 may be provided in a variety of different places to secure the components parts of the upper and lower latch mechanisms 30, 32 together as well as to the walls of the opening into which the barrier gate 40 is secured.

Figure 6:
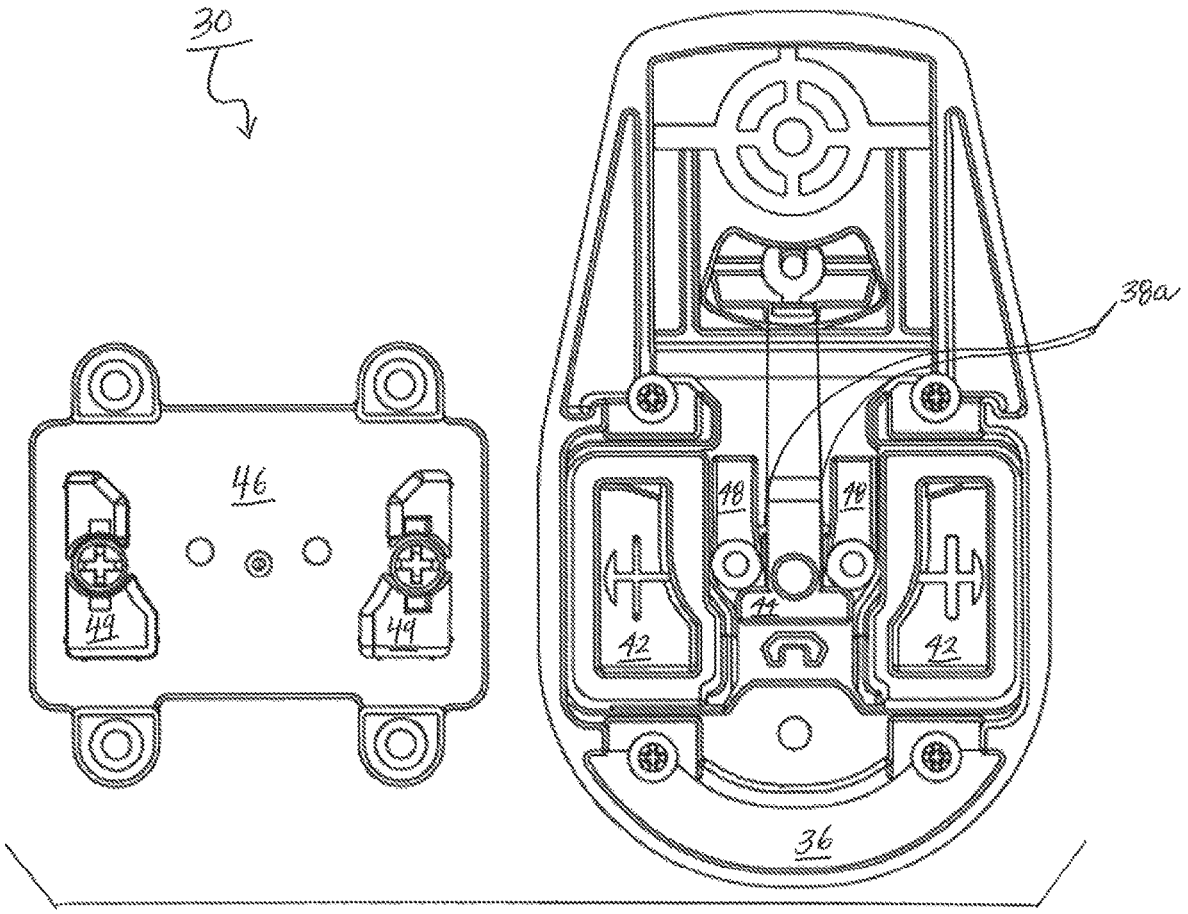
FIG. 6 shows a rear internal view of the upper catch mechanism with the rear cover removed therefrom.

FIG. 6 depicts a back view of the upper latch mechanism 30 with a back cover 46 removed from the keeper housing 36. As shown in a locked position, the retractable locking elements 42 are locked in an upright position from the front face of the keeper housing 36 and cannot be depressed such that the adjustable latch end 35 in the recess 37 cannot be removed from within the recess 37.

Figure 3:
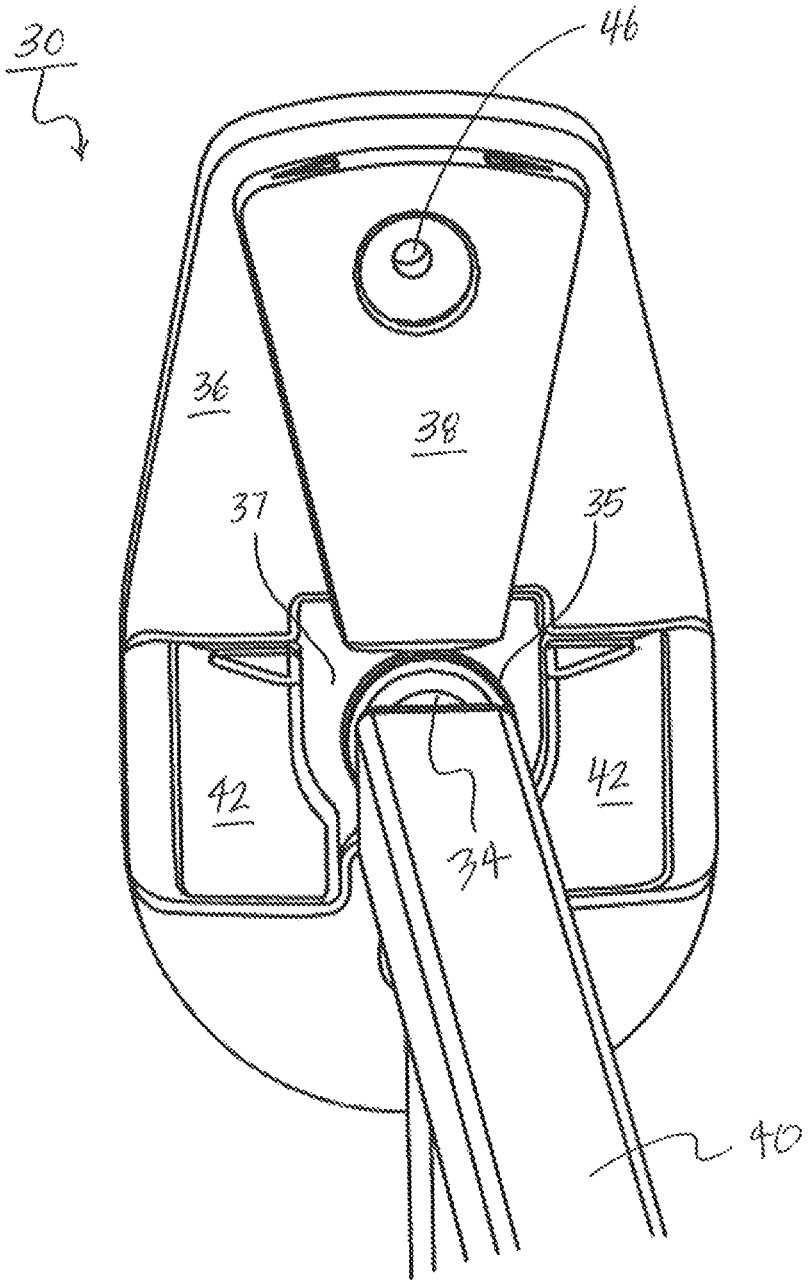
FIG. 3 illustrates a perspective view of the upper catch mechanism with the latch element secured therein.
Figure 7:
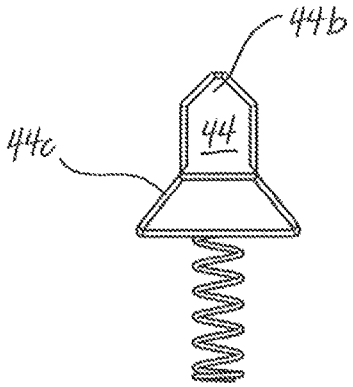
FIG. 7 depicts a view of the trigger.

Referring to FIGS. 3, 5 and 7, when the middle trigger 44 is depressed as a result of a latch element 34 being located in the recess 37 and pushing against the tip 44*b* of the trigger 44, the pair of swing plates 48 (shown in FIG. 6) are pivoted outward (like windshield wipers) over a back portion of the retractable locking elements 42. In this position, the retractable locking elements 42 cannot be depressed from the front and retracted inadvertently releasing the latch element 34.

The swing plates 48 are rotated outwards behind the retractable locking elements 42 thereby locking the retractable locking elements 42 when the trigger 44 is pushed down by the latch end 35 of the latch element 34. An outer surface 44*c* of the middle trigger 44 and outer contacting surfaces 48*ba* of the swing plates 48 are contoured to cause the swing plates 48 to open outward when the trigger 44 is depressed from the front side of the keeper housing 36. That is the outer surface 44*c* of the middle trigger 44 presses against the outer contacting surfaces 48*ba* of the swing plates 48 to urge them outward behind the retractable locking elements 42 to lock them in place.

Figure 9:
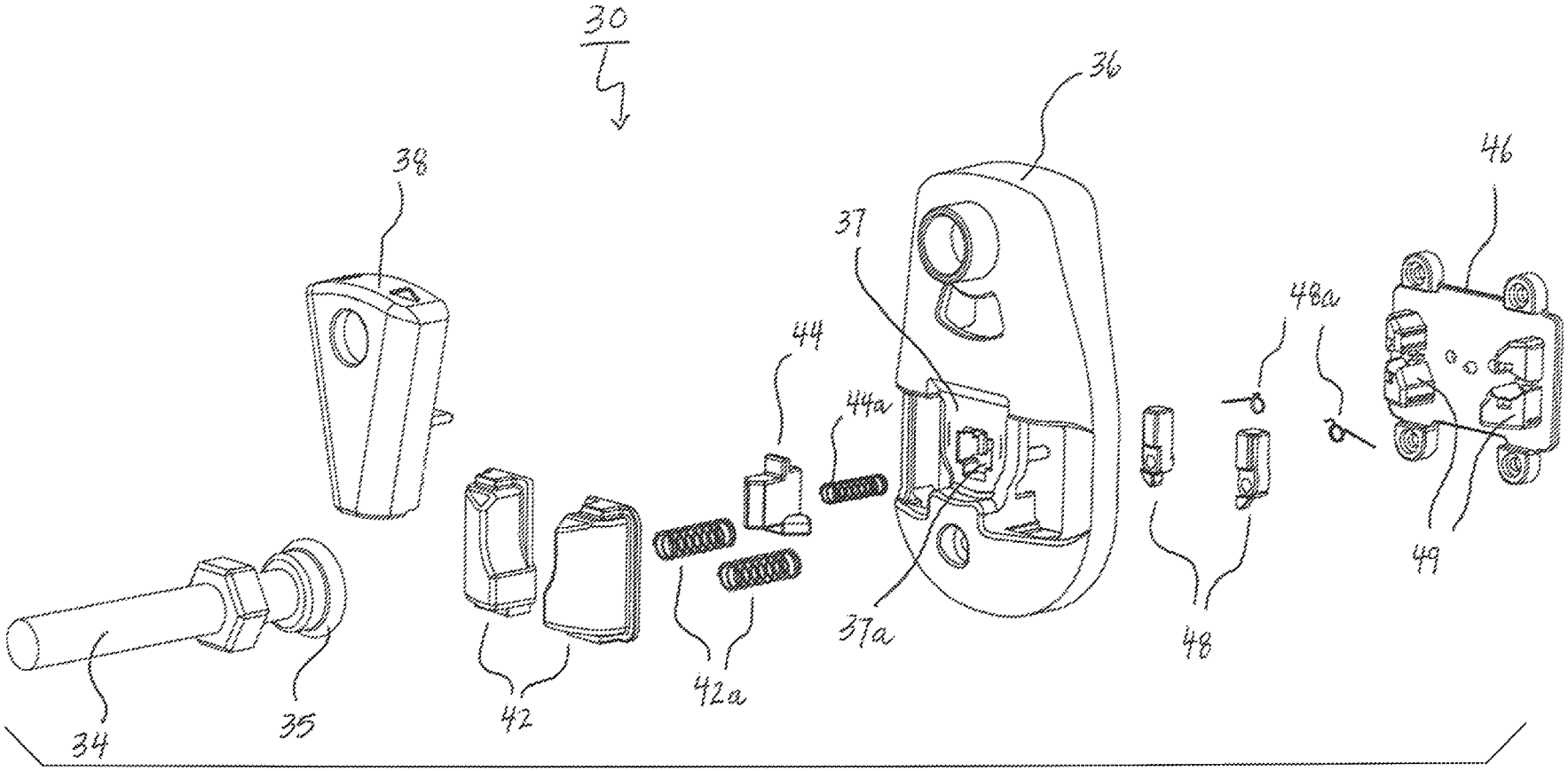
FIG. 9 shows an exploded perspective view of the upper catch mechanism and latch element.
Figure 14:
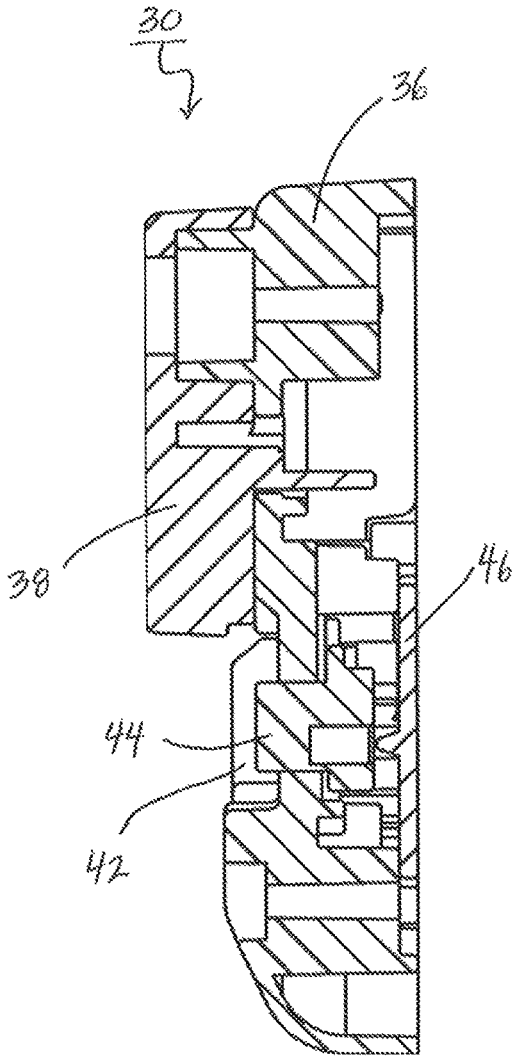
FIG. 14 is a cross section view of the upper catch mechanism.
Figure 15:
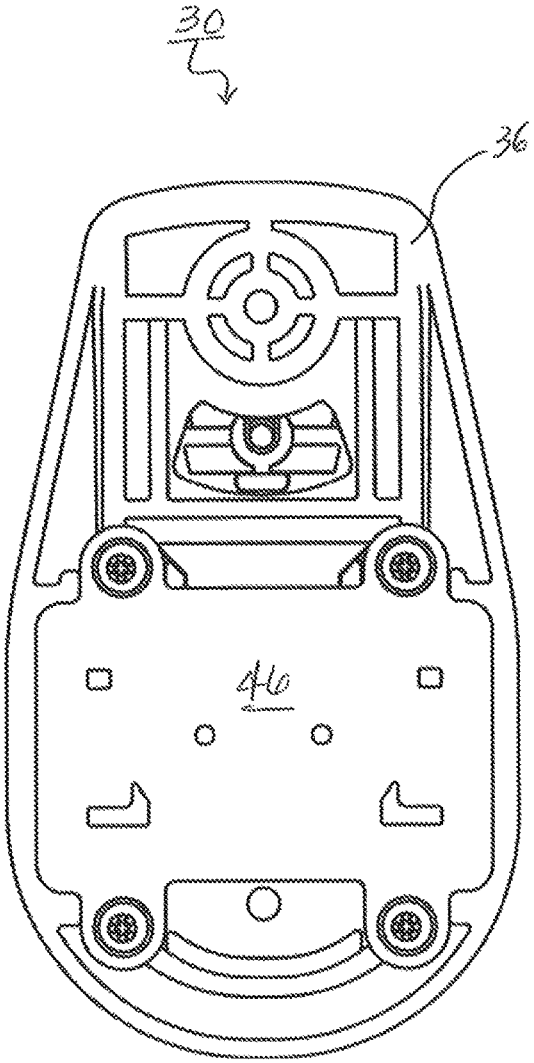
FIG. 15 illustrates a rear cross section view of the upper catch mechanism.

As shown in FIGS. 6 and 9, various springs 42*a* are provided to keep the retractable locking elements 42 biased outward. A spring 38*a* is provided to bias the pivoting locking element 38 into a vertical position. Another pair of springs 48*a* are provided to bias the swing plates 48 into an open position when the trigger 44 is released. Likewise, a trigger spring 44*a* is provided to bias the trigger 44 outward away from the keeper housing 36.

FIG. 9 depicts an exploded view of the upper latch mechanism 30. As shown, the latch element 34 and its adjustable end 35 are adapted to fit in a recess 37 defined by the pivoting locking element 38 and the retractable locking elements 42. A pair of springs 42*a* are positioned within the retractable locking elements 42 to bias the retractable locking elements 42 outward. A trigger 44 is disposed in a through-hole 37*a* in the recess 37 in the center of the keeper housing 36.

Figure 8:
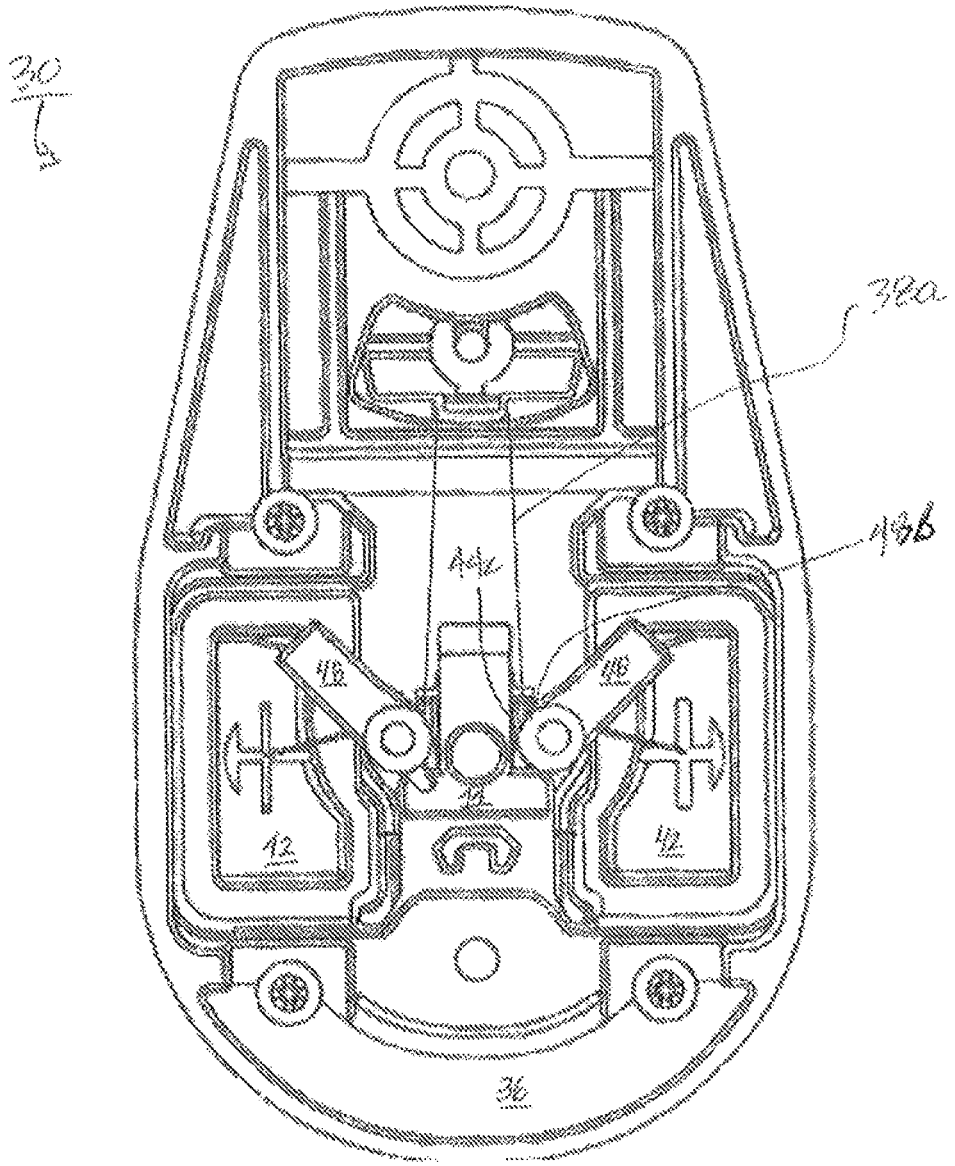
FIG. 8 illustrates another exploded rear internal view of the upper catch mechanism with the rear cover removed therefrom.

A pair of swing plates 48 are disposed within the keeper housing 36 and mechanically interconnected to the trigger 44 and the retractable locking elements 42. The pair of swing plate springs 48*a* are provided to bias the swing plates 48 inward into an unlocked position. A back cover 46 is provided with a pair of guides 49 integrated thereon to assist in the alignment and movement of the retractable locking elements 42 and the swing plate springs 48*a* into and out of the locked (as shown in FIG. 8 in which the retractable locking elements 42 cannot be retracted) and into an unlocked position in which the retractable locking elements 42 can be retracted.

FIGS. 10-15 show a front, side, top and bottom, side cross section and back cross section view of the upper latch mechanism 30.

Figure 16:
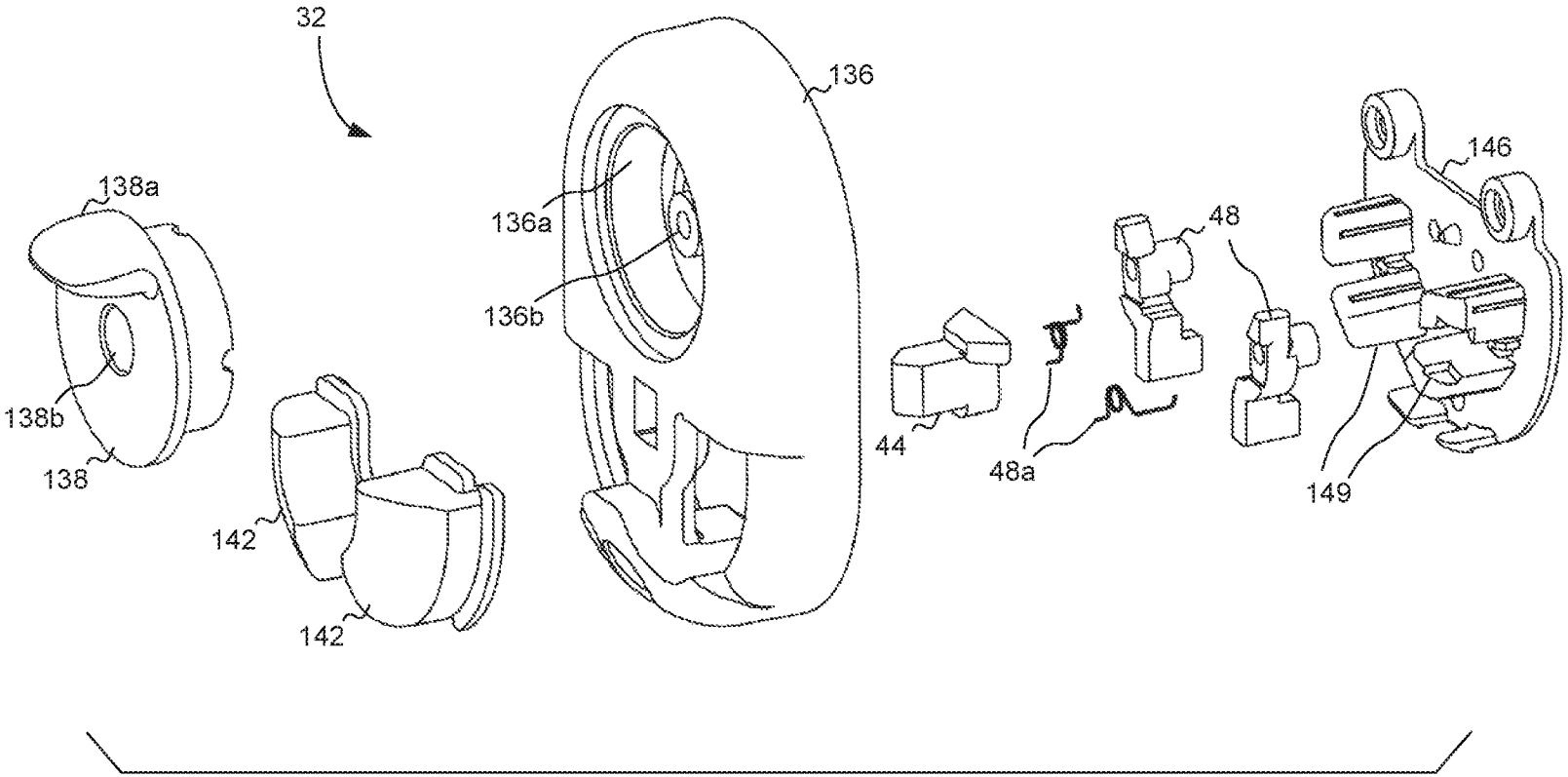
FIG. 16 shows an exploded perspective view of the lower catch mechanism.
Figure 21:
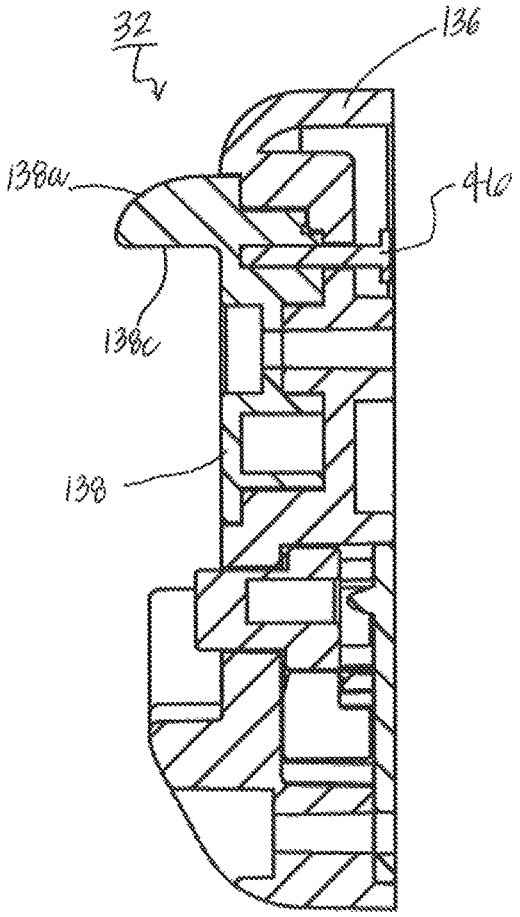
FIG. 21 is a cross section view of the lower catch mechanism.
Figure 22:
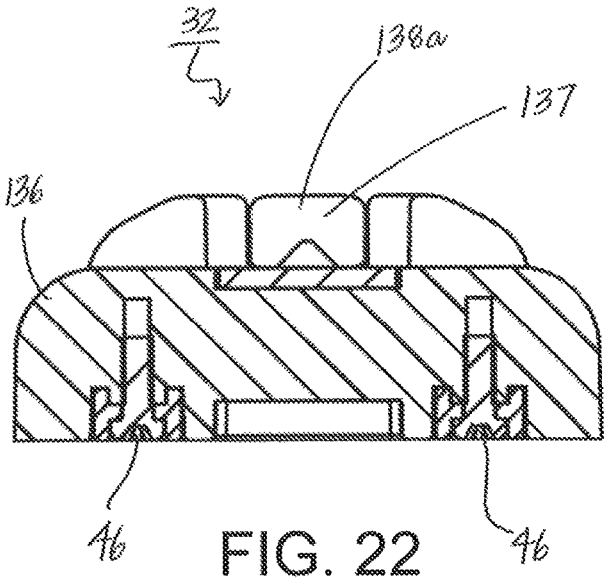
FIG. 22 depicts a rear cross section view of the lower catch mechanism.

FIG. 16 shows an exploded view of the lower latch mechanism 32. As before, the upper latch mechanism 30 and the lower latch mechanism 32 have similar features and functionality. For simplicity sake, overlapping details are similarly described above in more detail. Likewise, similar features and functionality are incorporated into the construction of the lower latch mechanism 32, such as with tension and compression springs, swing plates, a trigger, and the like. Likewise the lower latch mechanism 32 operates analogous to the upper latch mechanism 30 described above.

FIGS. 16-24 illustrate the lower latch mechanism 32. Referring back to FIG. 2A, a lower latch element 134 having an adjustable end 135 is adapted to fit in a semicircular recess 137 of the lower latch mechanism 32. The semicircular recess 137 is bounded and defined by a pair of retractable locking elements 142. It is to be understood that the retractable locking elements 142 may be constructed as a single retractable locking element. The semicircular recess 137 is adapted to snugly and securely receive the adjustable end 135 of the lower latch element 134.

A pair of springs (not shown but similar to 42*a* shown in FIG. 9) may be positioned within the retractable locking elements 142 to bias the retractable locking elements 142 outward of the keeper housing 136 as similarly described above with respect to the function shown in FIG. 9 in more detail.

As with the earlier embodiment, a trigger and a pair of swing plates may also be provided in the keeper housing 136 in this embodiment and may operate similar to the functionality described above with respect to the upper latch element 30. A back covet 146 may also be provided with a pair of guides 149 integrated thereon to assist in the alignment and movement of the retractable locking elements 142 into and out of the keeper housing 136.

The lower latch mechanism 32 includes a rotating stopper element 138 having a stopper flange 138. The rotating stopper element 138 is constructed as a circular element having a central fastener opening 138*b* adapted to fit within a circular recess 136*a* and over a central projection 136*b* in the keeper housing 136.

The rotating stopper element 138 can be rotated into various positions to allow a barrier gate 40 to swing in selected desired directions. A fastener may be provided within a central fastener opening 138*b* to securely lock the rotating stopper element 138 into a desired position. For example, in a locked position, the rotating stopper element 138 may secure the rotating stopper element 138 in a particular circular orientation. That is, the fastener 46 extending through the central fastener opening 138*b* of the rotating stopper element 138 is threaded in place and the projection 136*b* of the keeper housing 138 is secured. The rotating stopper element 138 may be secured into position in a variety of different ways, including but not limited to providing a fastener, a spring biased lock, a friction fit tension and/or any other suitable method for fastening the rotating stopper element 138 in a particular orientation.

Figure 23:
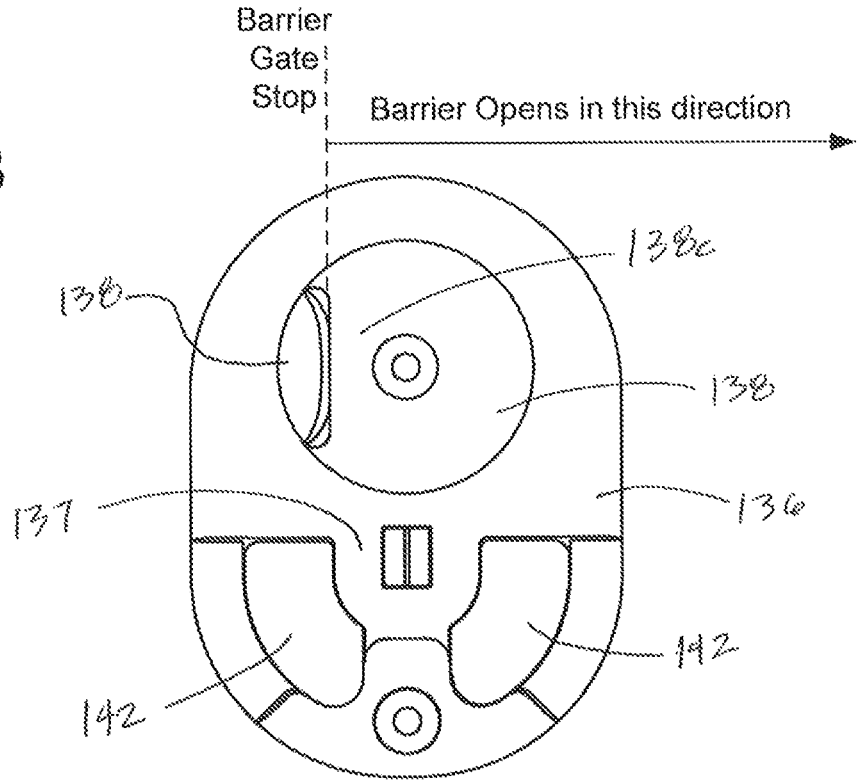
FIG. 23 is a front view of the lower catch mechanism with the stopper element in a first position.

The advantage of the construction of the lower latch mechanism 32 is that the lower latch mechanism 32 can be adjustably positioned to cause the barrier gate 40 to open and close in a variety of specific directions. By way of example, when a stopper flange 138*a* is in a first position (as shown in FIG. 23), the barrier gate 40 is able to move in only a first rightward direction. That is, when the stopper flange 138*a* of the rotating stopper element 138 on the lower catch mechanism 32 is attached to an entryway and disposed in the position shown in FIG. 23, the barrier door 40 can be lifted and swung open from the lower latch mechanism 32 outward to the right. When the barrier gate 40 is closed, the left side of the open barrier gate 40 will come to a complete stop when the side of the barrier gate 40 comes into contact with the inner flat surface 138*c* of the retractable locking element 42. That is, the latch end 135 of the lower latch element slides over the top of the rightmost retractable locking element 42 depressing it as it travels over it. Once the latch end 135 clears the leftmost end of the rightmost retractable locking element 42 the rightmost retractable locking element 42 will extend back outward away from the keeper housing 136, locking the latch end 135 within the semicircular recess 137 defined between the two retractable locking elements 42. The ends of the retractable locking elements 42 are constructed to permit the latch end 135 to slide over their ends.

Figure 24:
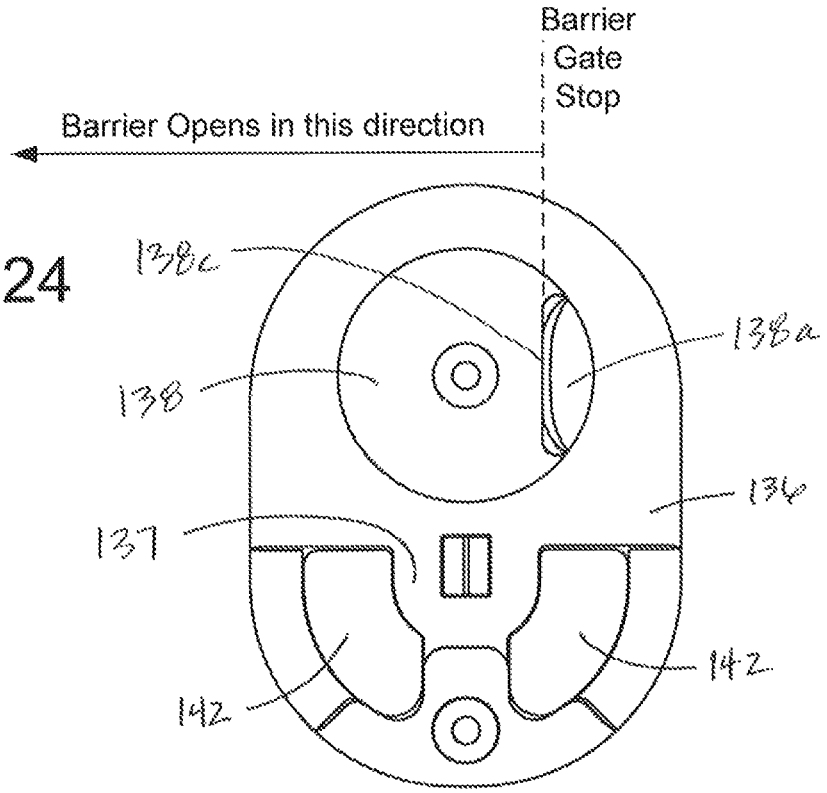
FIG. 24 is a front view of the lower catch mechanism with the stopper element in a second position.

In a second example, when the stopper flange 138*a* is in a second position (as shown in FIG. 24), the barrier gate 40 is able to move in only a leftward direction. That is, when the stopper flange 138*a* of the rotating stopper element 138 on the lower catch mechanism 32 is attached to are entryway and disposed in the position shown in FIG. 24, the barrier door 40 is able to be lifted and swung open from the lower latch mechanism 32 outward to the left. When the barrier gate 10 is closed, the right side of the open barrier gate 40 will come to a complete stop when the right side of the barrier gate 40 comes into contact with the flat surface of the retractable locking element 42. That is, the barrier gate 40 comes into contact with the flat surface 138*c*, the latch end 135 of the lower latch element slides over the top of the leftmost retractable locking element 42 depressing it so that it travels over it and lock into place in the recess 137. Once the latch end 135 clears the rightmost end of the leftmost retractable locking element 42 the leftmost retractable locking element 42 will extend back outward away from the keeper housing 136 locking the latch end 135 within the semicircular recess 137 defined between the two retractable locking elements 42.

Figure 25:
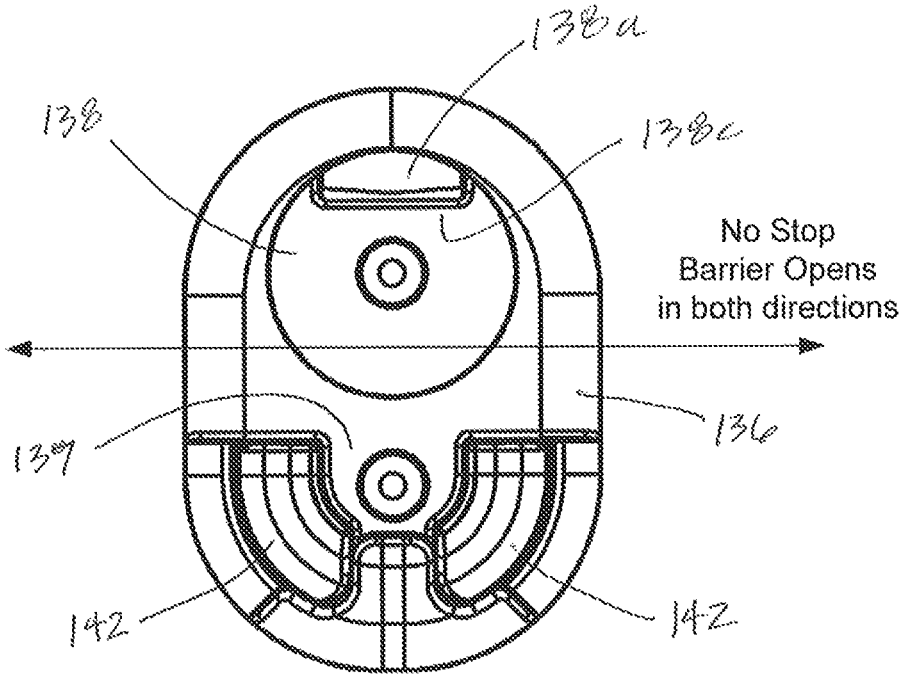
FIG. 25 is a front view of the lower catch mechanism with the stopper element in a third position.

In a third example when the stopper flange 138*a* is in a third position (as shown in FIG. 25), the barrier gate 40 is able to move in both a leftward and rightward direction. That is, when the stopper flange 138*a* of the rotating stopper element 138 on the rawer catch mechanism 32 is attached to an entryway and disposed in the position shorn in FIG. 17, the barrier door 40 can be lifted from within the recess 137 and swung open from the lower latch mechanism 32 outward to the left or the right because the stopper flange 138*a* will not impeded the left or right movement of the latch end 135 of the barrier gate 40. Therefore, when the barrier gate 40 is closed from the left or right, the incoming side of the open barrier gate 40 will come to a stop after the incoming side of the latch element 135 of the barrier gate 40 has slid over the closest retractable locking element 142 and comes into contact with the inner surface of the furthest retractable locking element 142, locking the latch element 135 into place within the semicircular recess 137 defined between the two retractable locking elements 42.

What has been described above includes examples of a latching assembly for a barrier gate that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term comprising as "comprising" is interpreted when employed as a transitional word in a claim.

The invention claimed is:

1. A latch assembly for a barrier gate, comprising:

a housing comprising:

a cavity formed by at least one retractable locking element and a pivoting locking element, the at least one retractable locking element being biased to an extended position;

a retractable trigger disposed within the cavity and adapted to depress when a first latch element of the barrier gate is received within the cavity, the trigger being biased to an extended position;

wherein when the trigger is depressed, at least one swing plate rotates causing the at least one retractable locking element to become fixed in its extended position and is prevented from being depressed, thereby securing the first latch element within the cavity.

2. The latch assembly of claim 1, wherein the at least one retractable locking element comprises a pair of retractable locking elements.

3. The latch assembly of claim 2, wherein the pair of retractable locking elements are positioned on opposing sides of the cavity.

4. The latch assembly of claim 2, wherein the first latch element is secured within the cavity by the pair of retractable locking elements and the pivoting locking element.

5. The latch assembly of claim 4, wherein the first latch element is adapted to be removed from the cavity by pivoting the pivoting locking element, and lifting the first latch element out from the cavity formed by the pair of retractable locking elements.

6. The latch assembly of claim 2, wherein the at least one swing plate comprises a pair of swing plates which rotate, when the trigger is depressed, to block the retractable locking elements from being depressed from their extended positions.

7. The latch assembly of claim 1, wherein the first latch element is adapted to depress the trigger and/or the at least one retractable locking element.

8. The latch assembly of claim 1, further comprising at least one spring which is adapted to bias the at least one swing plate to a biased position, which allows the at least one retractable locking element to be depressed.

9. The latch assembly of claim 1, further comprising at least one spring to bias the at least one retractable locking element to the extended position.

10. The latch assembly of claim 1, further comprising a trigger spring to bias the trigger to the extended position.

11. The latch assembly of claim 1, further comprising a second housing having a multi-positional rotating stopper element adapted to control the motion of a second latch element of the barrier gate.

12. The latch assembly of claim 11, wherein the rotating stopper element is adapted to block the barrier gate from advancing past the rotating stopper element.

13. The latch assembly of claim 12, wherein the rotating stopper element is adapted to permit movement of the barrier gate in at least one of: a first swinging direction in a first position; a second swinging direction in a second position; and the first and the second swinging directions in a third position.

14. A latch assembly for a barrier gate, comprising:

a housing comprising:

a cavity formed by a pair of retractable locking elements and a pivoting locking element, the retractable locking elements being biased to respective extended positions and positioned on opposing sides of the cavity;

a retractable trigger disposed within the cavity and adapted to depress when a first latch element of the barrier gate is received within the cavity, the trigger being biased to an extended position; and a pair of swing plates which rotate to block the retractable locking elements from retracting from their extended positions when the trigger is depressed, thereby securing the first latch element within the cavity.

15. The latch assembly of claim 14, further comprising a second housing having a multi-positional rotating stopper element adapted to control the motion of a second latch element of the barrier gate.

16. The latch assembly of claim 15, wherein the rotating stopper element is adapted to block the barrier gate from advancing past the rotating stopper element.

17. The latch assembly of claim 16, wherein the rotating stopper element is adapted to permit movement of the barrier gate in at least one of: a first swinging direction in a first position; a second swinging direction in a second position; and the first and the second swinging directions in a third position.

18. A latch assembly for a barrier gate, comprising:

a first housing comprising:

a cavity formed by a pair of retractable locking elements and a pivoting locking element, the retractable locking elements being biased to respective extended positions and positioned on opposing sides of the cavity;

a retractable trigger disposed within the cavity and adapted to depress when a first latch element of the barrier gate is received within the cavity, the trigger being biased to an extended position;

a pair of swing plates which rotate to block the retractable locking elements from retracting from their extended positions when the trigger is depressed, thereby securing the latch element within the cavity; and a second housing comprising:

a multi-positional rotating stopper element adapted to control the motion of a second latch element of the barrier gate;

wherein the rotating stopper element is adapted to block the barrier gate from advancing past the rotating stopper element.

19. The latch assembly of claim 18, wherein the first latch element is adapted to be removed from the cavity by pivoting the pivoting locking element, and lifting the first latch element our from the cavity formed by the pair of retractable locking elements.

* * * * *